US011361724B2

(12) United States Patent
He

(10) Patent No.: US 11,361,724 B2
(45) Date of Patent: Jun. 14, 2022

(54) DRIVE CIRCUIT OF DISPLAY DEVICE, AND DISPLAY DEVICE

(71) Applicant: HKC CORPORATION LIMITED, Shenzhen (CN)

(72) Inventor: HuaiLiang He, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 451 days.

(21) Appl. No.: 16/349,985

(22) PCT Filed: Dec. 4, 2018

(86) PCT No.: PCT/CN2018/119069
§ 371 (c)(1),
(2) Date: May 15, 2019

(87) PCT Pub. No.: WO2020/103190
PCT Pub. Date: May 28, 2020

(65) Prior Publication Data

US 2021/0327383 A1 Oct. 21, 2021

(30) Foreign Application Priority Data

Nov. 21, 2018 (CN) ..... 201811389128.6

(51) Int. Cl.
*G09G 3/36* (2006.01)
*G09G 3/3208* (2016.01)

(52) U.S. Cl.
CPC ... *G09G 3/3677* (2013.01); *G09G 2310/0286* (2013.01); *G09G 2310/08* (2013.01); *G09G 2320/0233* (2013.01)

(58) Field of Classification Search
CPC ..... G09G 2320/0233
See application file for complete search history.

(56) References Cited

U.S. PATENT DOCUMENTS 9,870,750 B2 1/2018 Koo et al.
11,054,709 B2 * 7/2021 Nakagawa ..... G02F 1/13454
(Continued)

FOREIGN PATENT DOCUMENTS

CN 1976051 A 6/2007
CN 201715962 U 1/2011
(Continued)

OTHER PUBLICATIONS

International Search Report issued in corresponding International application No. PCT/CN2018/119069. dated Aug. 20, 2019 (7 pages).
(Continued)

*Primary Examiner* — Sepehr Azari

(57) ABSTRACT

Disclosed are a drive circuit of a display device, and a display device. The drive circuit includes: a plurality of sets of transmission signal lines; a set of clock signal lines, in signal connection with a timing drive circuit separately to acquire a gate drive clock signal; and a compensation capacitor, connected in parallel to each transmission signal line, each transmission signal line in each set of transmission signal lines being in signal connection with a clock signal line corresponding to a set of clock signal lines, where the compensation capacitance corresponding to the transmission signal line, closer to the timing drive circuit, in each set of transmission signal lines is smaller.

20 Claims, 6 Drawing Sheets

(56) References Cited

U.S. PATENT DOCUMENTS

2006/0267914 A1* 11/2006 Chang ..... G02F 1/1345 345/100
2008/0157364 A1* 7/2008 Yang ..... G02F 1/136286 257/741
2009/0184946 A1* 7/2009 Ahn ..... G09G 3/3225 345/206
2011/0074743 A1* 3/2011 Son ..... G09G 3/20 345/204
2012/0162179 A1* 6/2012 Tanaka ..... G09G 3/3677 345/211
2012/0235983 A1* 9/2012 Sakamoto ..... G09G 3/3655 345/212
2012/0327057 A1* 12/2012 Sakamoto ..... G11C 19/28 345/211
2017/0200420 A1* 7/2017 No ..... G09G 3/3275
2018/0204889 A1* 7/2018 Yu ..... H01L 27/3223
2018/0308445 A1* 10/2018 Park ..... G09G 3/3233

FOREIGN PATENT DOCUMENTS

CN 103745707 A 4/2014
CN 104730792 A 6/2015
CN 205375442 U 7/2016
CN 106328064 A 1/2017
CN 107978293 A 5/2018
CN 108231790 A 6/2018

OTHER PUBLICATIONS

First Office Action from China patent office in a counterpart Chinese patent Application 201811389128.6, dated Nov. 22, 2019 (11 pages).
Second Office Action from China patent office in a counterpart Chinese patent Application 20181 1389128.6, dated Apr. 28, 2020 (10 pages).
Written Opinion of the International Searching Authority for No. PCT/CN2018/119069.

* cited by examiner

DRIVE CIRCUIT OF DISPLAY DEVICE, AND DISPLAY DEVICE

This application claims the priority to the Chinese Patent Application No. CN201811389128.6, filed with National Intellectual Property Administration, PRC on Nov. 21, 2018 and entitled "DRIVE CIRCUIT OF DISPLAY DEVICE, AND DISPLAY DEVICE", which is incorporated herein by reference in its entirety.

TECHNICAL FIELD

This application relates to the field of display technologies, and more particularly to a drive circuit of a display device, and a display device.

BACKGROUND

The description herein provides only background information related to this application, but does not necessarily constitute the existing technology.

With the development and progress of science and technology, liquid crystal displays have lots of advantages such as thinness, power saving, and no radiation, and are widely applied. Most of the liquid crystal displays on the market are backlight type liquid crystal displays, including liquid crystal panels and backlight modules. The liquid crystal panels include a color filter (CF) substrate and a thin film transistor (TFT) substrate, the opposite inner sides of the above substrates having transparent electrodes. A layer of liquid crystal (LC) molecules is sandwiched between the two substrates, the arrangement of a gate on array (GOA) on the array substrate is an important technology in panel design, which is mainly advantageous in that the cost is reduced by removing a gate driver IC, gate driver function generates a logical circuit using an array exposure and development mode to drive a scanning data line, and the GOA drives a scanning line through a gate circuit using a clock signal.

However, as display panels are increasing in size, the arrangement mode of data lines and scanning lines results in different signal transmission losses to cause the effect of non-uniform display effects at different locations.

SUMMARY

In view of the above defects, this application provides a drive circuit of a display device and a display device, to achieve a uniform display effect of a display panel.

The purpose of the application provides a drive circuit of a display panel, comprising:

a timing drive circuit and a scanning drive circuit, the scanning drive circuit comprising: a plurality of sets of transmission signal lines; a set of clock signal lines, in signal connection with the timing drive circuit separately to acquire a gate drive clock signal; and a compensation capacitor, connected in parallel to each transmission signal line, each transmission signal line in each set of transmission signal lines being in signal connection with a clock signal line corresponding to a set of clock signal lines, wherein the compensation capacitance corresponding to the transmission signal line, closer to the timing drive circuit, in each set of transmission signal lines is smaller.

Optionally, the scanning drive circuit comprises a common electrode layer and a metal bridging hole; each transmission signal line is connected to the corresponding clock signal line through the metal bridging hole;

the metal bridging hole comprises a conductive layer, a first bridging hole and a second bridging hole;

the clock signal line and the transmission signal line are located in different manufacture procedures; the conductive layer and the clock signal line are connected to form the first bridging hole; the conductive layer and the transmission signal line are connected to form the second bridging hole; and the common electrode layer and the conductive layer form the compensation capacitor.

Optionally, the quantity of first bridging holes corresponding to the transmission signal line, closer to the timing drive circuit, in the same set of transmission signal lines is greater.

Optionally, metal bridging holes corresponding to the transmission signal line, farther away from the timing drive circuit, in the same set of transmission signal lines comprise at least one first bridging hole.

Optionally, the quantity of first bridging holes corresponding to a transmission signal line, closer to the timing drive circuit, in various transmission signal lines connected to the same clock signal line among different sets of transmission signal lines is greater.

Optionally, the area of a conductive layer corresponding to the transmission signal line, closer to the timing drive circuit, in the same set of transmission signal lines is greater.

Optionally, the area of a conductive layer corresponding to a transmission signal line, closer to the timing drive circuit, in various transmission signal lines connected to the same clock signal line among different sets of transmission signal lines is smaller.

Optionally, the sum of compensation capacitances of each transmission signal line and the sum of parasitic capacitances on the corresponding transmission signal line in each set of transmission signal lines are equal.

This application also discloses a drive circuit of a display panel, comprising: a timing drive circuit and a scanning drive circuit, the scanning drive circuit comprising: a plurality of sets of transmission signal lines; a set of clock signal lines, in signal connection with the timing drive circuit separately to acquire a gate drive clock signal; a common electrode layer; and a metal bridging hole, wherein each transmission signal line in each set of transmission signal lines is in signal connection with a clock signal line corresponding to a set of clock signal lines; each transmission signal line is connected to the corresponding clock signal line through the metal bridging hole;

the metal bridging hole comprises a conductive layer, a first bridging hole and a second bridging hole;

the clock signal line and the transmission signal line are located in different manufacture procedures; the conductive layer and the clock signal line are connected to form the first bridging hole; the conductive layer and the transmission signal line are connected to form the second bridging hole; and the quantity of first bridging holes corresponding to the transmission signal line, closer to the timing drive circuit, in the same set of transmission signal lines is greater; and the quantity of first bridging holes corresponding to a transmission signal line, closer to the timing drive circuit, in various transmission signal lines connected to the same clock signal line among different sets of transmission signal lines is greater.

This application also discloses a display device. The display device comprises a drive circuit, the drive circuit comprising:

a timing drive circuit; and a scanning drive circuit, the scanning drive circuit comprising:

a plurality of sets of transmission signal lines;

a set of clock signal lines, in signal connection with the timing drive circuit separately to acquire a gate drive clock signal; and a compensation capacitor, connected in parallel to each transmission signal line, each transmission signal line in each set of transmission signal lines being in signal connection with a clock signal line corresponding to a set of clock signal lines, wherein the compensation capacitance corresponding to the transmission signal line, closer to the timing drive circuit, in each set of transmission signal lines is smaller.

Optionally, the scanning drive circuit comprises a common electrode layer and a metal bridging hole; each transmission signal line is connected to the corresponding clock signal line through the metal bridging hole;

the metal bridging hole comprises a conductive layer, a first bridging hole and a second bridging hole;

the clock signal line and the transmission signal line are located in different manufacture procedures; the conductive layer and the clock signal line are connected to form the first bridging hole; the conductive layer and the transmission signal line are connected to form the second bridging hole; and the common electrode layer and the conductive layer form the compensation capacitor.

Optionally, the quantity of first bridging holes corresponding to the transmission signal line, closer to the timing drive circuit, in the same set of transmission signal lines is greater.

Optionally, metal bridging holes corresponding to the transmission signal line, farther away from the timing drive circuit, in the same set of transmission signal lines comprise at least one first bridging hole.

Optionally, the quantity of first bridging holes corresponding to a transmission signal line, closer to the timing drive circuit, in various transmission signal lines connected to the same clock signal line among different sets of transmission signal lines is greater.

Optionally, the area of a conductive layer corresponding to the transmission signal line, closer to the timing drive circuit, in the same set of transmission signal lines is greater.

Optionally, the area of a conductive layer corresponding to a transmission signal line, closer to the timing drive circuit, in various transmission signal lines connected to the same clock signal line among different sets of transmission signal lines is smaller.

Optionally, the sum of compensation capacitances of each transmission signal line and the sum of parasitic capacitances on the corresponding transmission signal line in each set of transmission signal lines are equal.

Compared with an exemplary display panel, in this application, for the same set of transmission signal lines connected to different clock signal lines, the capacitance of a transmission signal line correspondingly connected to a clock signal line close to a display area is different from the capacitance of a transmission signal line correspondingly connected to a clock signal line away from the display area, and losses caused by different capacitance sizes are also different. In the same set of transmission signal lines connected to different clock signal lines, the capacitance of the transmission signal line correspondingly connected to the clock signal line close to the display area is reduced to balance the situation of different losses caused by unequal capacitances due to line arrangement difference, such that the capacitance loss of a transmission signal line away from a timing control chip in a set of transmission signal lines is reduced, and the display effect of the display panel is more uniform accordingly.

BRIEF DESCRIPTION OF DRAWINGS

The accompanying drawings included are used for helping understand the embodiments of this application, constitute a part of this specification, illustrate examples of the embodiments of this application and, together with the description, serve to explain the principles of this application. Apparently, the accompanying drawings in the following description merely show some embodiments of this application, and persons of ordinary skill in the art may still derive other drawings from these accompanying drawings without creative effort. In the figures.

DETAILED DESCRIPTION

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly include one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

Figure 1:
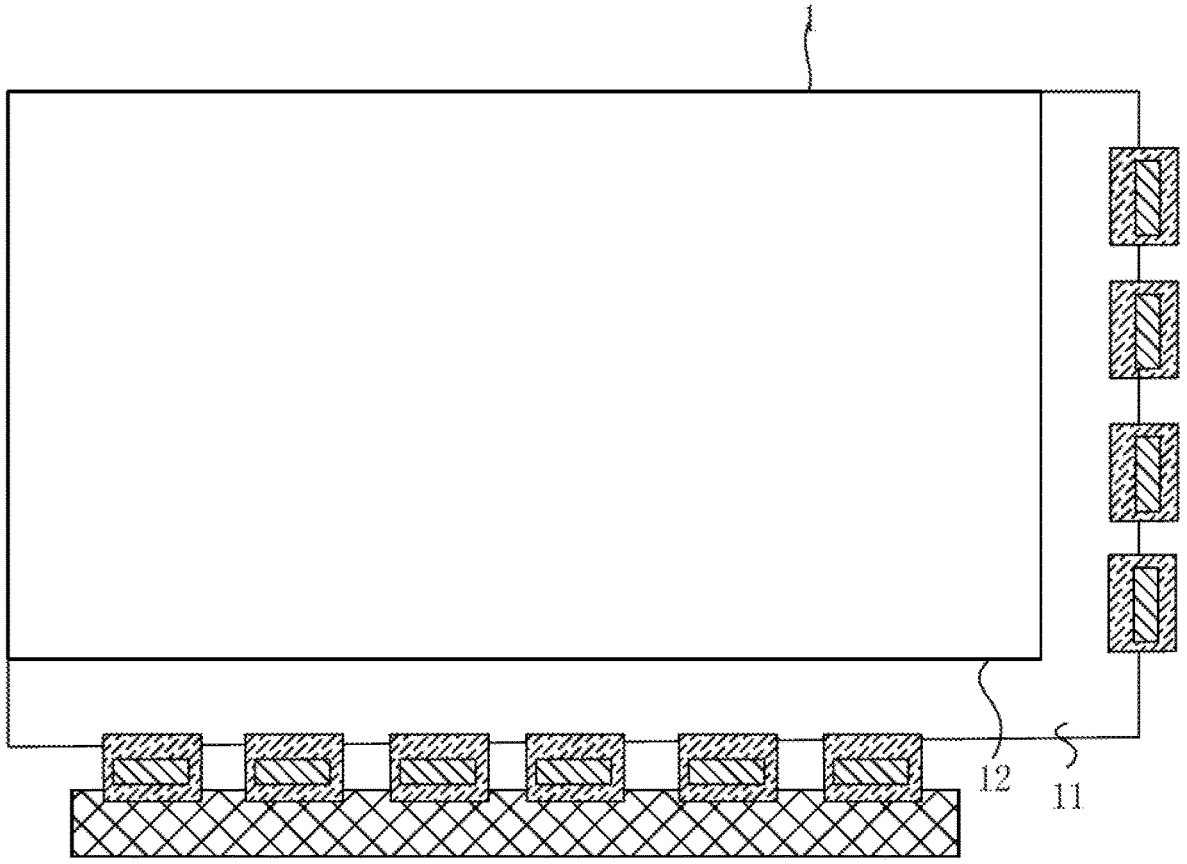
FIG. 1 is a schematic diagram of a display device according to one embodiment of this application.
Figure 2:
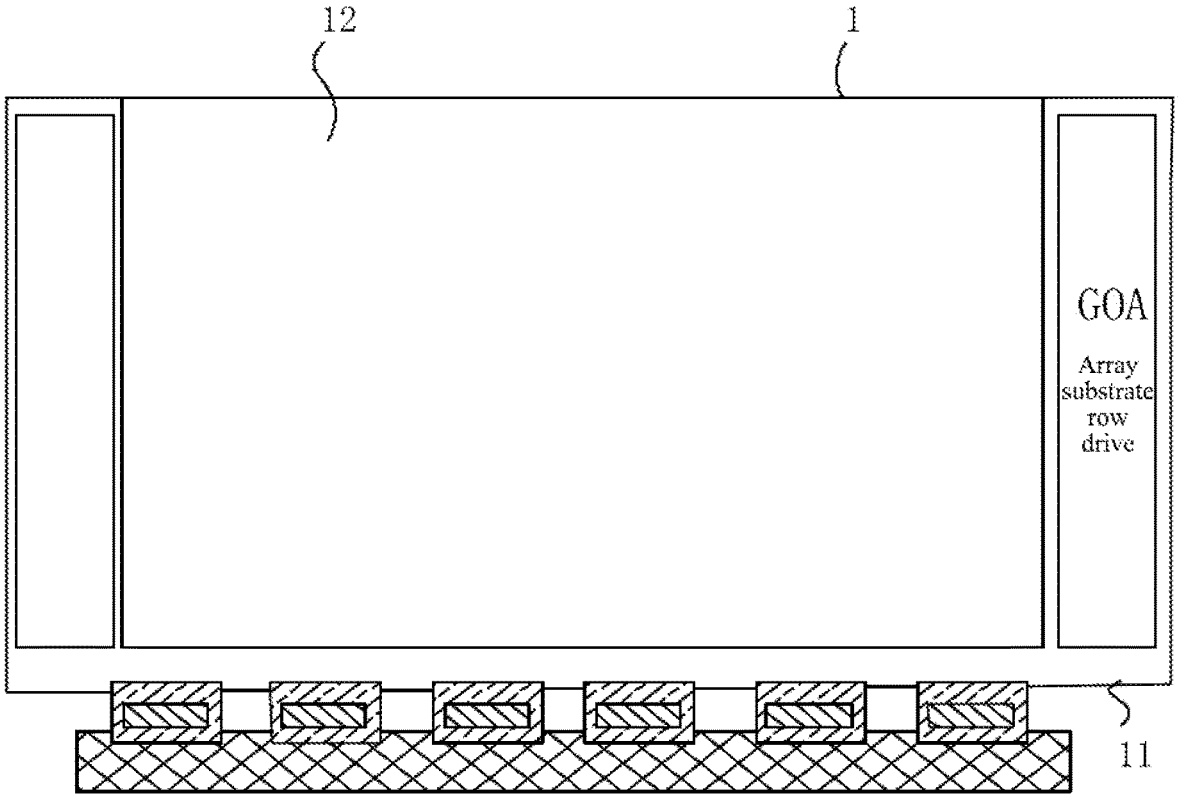
FIG. 2 is a schematic diagram of another display device according to one embodiment of this application.
Figure 3:
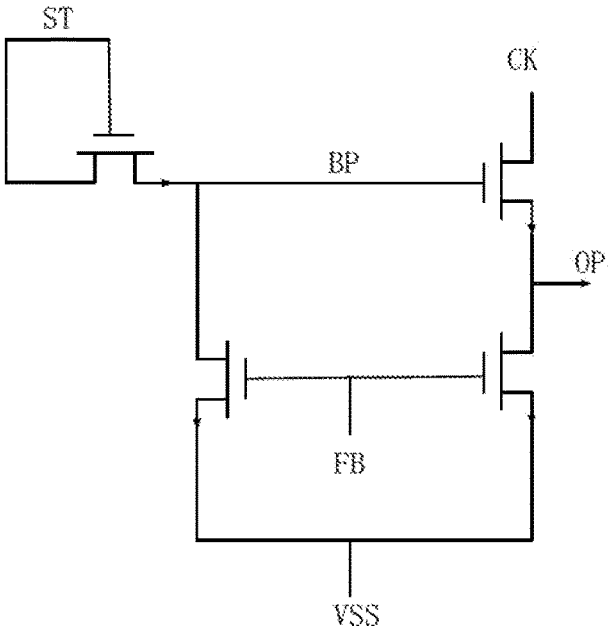
FIG. 3 is a schematic diagram of a GOA circuit according to one embodiment of this application.
Figure 4:
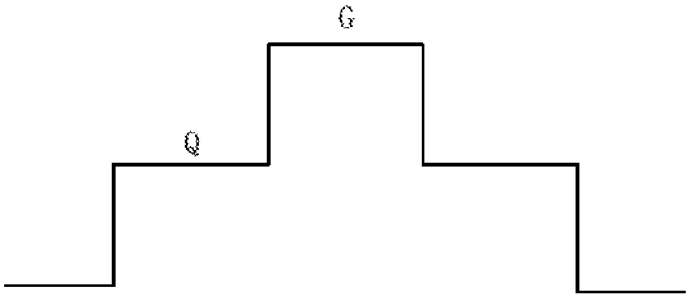
FIG. 4 is a schematic diagram of a clock signal according to one embodiment of this application.

As shown in FIG. 1 to FIG. 4, the arrangement of a gate on array (GOA) on an army substrate may reduce, in panel design, the cost by removing a gate driver IC, an original gate driver function generates a logical circuit using an array exposure and development mode to drive a scanning data line, and the GOA drives a scanning line through a gate circuit using a clock signal. As shown in FIG. 3, BP in the figure is a boost point, and OP is output. As shown in FIG. 4, Q is Q point pre-charge, and G is gate output. The principle of a GOA circuit is developed on the basis of a Tompson circuit. Generally, when the GOA works, the boost point has a pre-charge signal (st) to pre-charge this point, such that when the boost point is coupled to a clock signal, the boost point reaches a high-voltage level, and a thin film transistor (TFT) is turned on to make a signal smoothly transferred.

Figure 6:
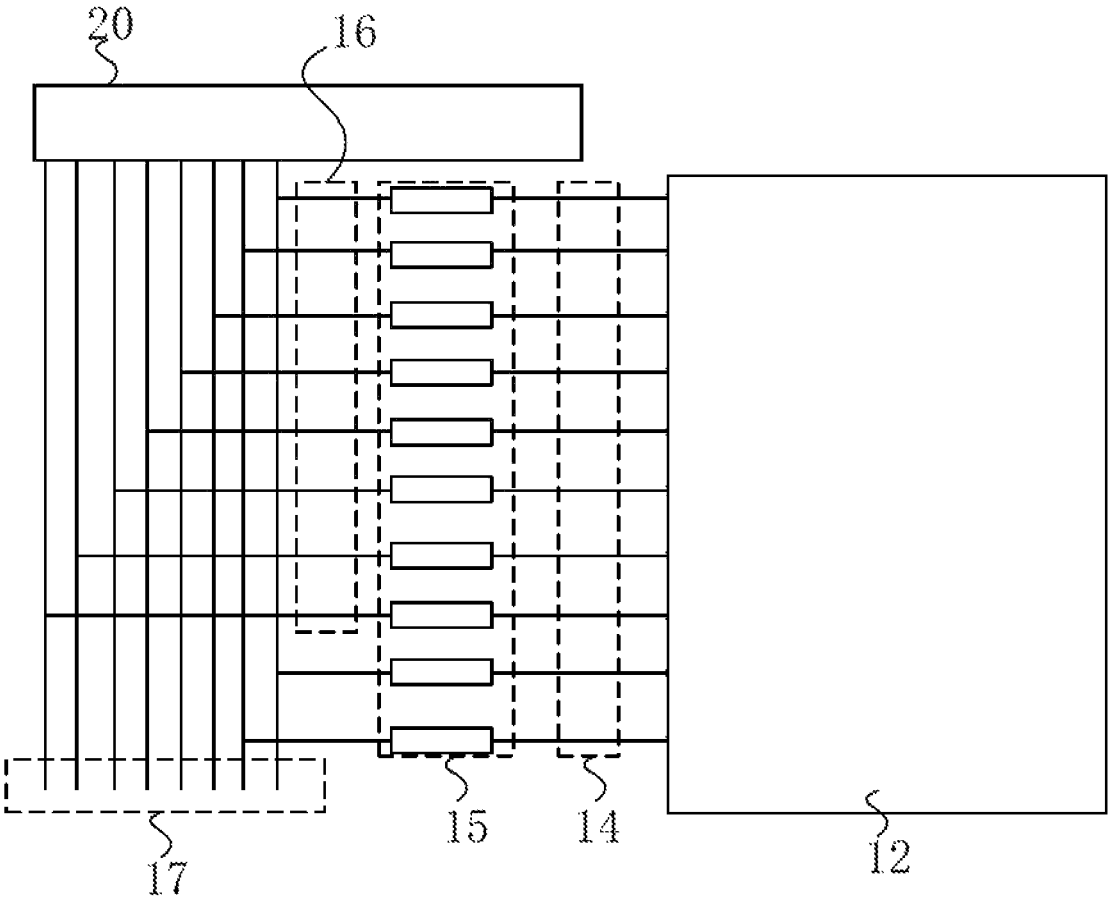
FIG. 6 is a schematic diagram of a scanning drive circuit according to one embodiment of this application.

As shown in FIG. 6, the transmission signal lines 16 are connected to scanning lines through a gate on array 15, the scanning lines 14 are determined according to the screen resolution such as a resolution FHD (1920×1080), the scanning lines 14 are under the arrangement of pixels 1G1D, and there are 1080 scanning lines 14. However, the clock signal is intended to be responsible for providing signals to drive these scanning lines 14, and the clock signal may allocate the scanning lines 14 according to a signal quantity. As shown in FIG. 2, the presence of 8 clock signal lines 17 is taken as an example. In the case of 1080 scanning lines 14, one clock signal line 17 is in charge of 1080/8=135 scanning lines 14. In FIG. 2, one set of clock signal lines 17 includes 8 clock signal lines 17, one clock signal line 17 corresponds to 135 scanning lines 14, one set of scanning lines 14 corresponds to 8 scanning lines 14, which are connected to 8 clock signal lines 17 one by one through the corresponding 8 transmission signal lines 16.

This application is described below with reference to the accompanying drawings and embodiments.

As shown in FIG. 5 to FIG. 8, an embodiment of this application discloses a drive circuit of a display panel, including: a timing drive circuit 20 and a scanning drive circuit 13. The scanning drive circuit 13 includes: a plurality of sets of transmission signal lines 16; a set of clock signal lines 17, in signal connection with a timing drive circuit 20 separately to acquire a gate drive clock signal; and a compensation capacitor, connected in parallel to each transmission signal line 16, each transmission signal line 16 in each set of transmission signal lines 16 being in signal connection with a clock signal line 17 corresponding to a set of clock signal lines 17, where the compensation capacitance corresponding to the transmission signal line 16, closer to the timing drive circuit 20, in each set of transmission signal lines 16 is smaller.

In this solution, the signal transmission loss of the transmission signal line 16 close to the timing drive circuit 20 in a set of transmission signal lines 16 is smaller than that of the transmission signal line 16 away from the timing drive circuit 20. As the capacitance is larger, the signal transmission loss is smaller, the compensation capacitance of the transmission signal line 16 away from the timing drive circuit 20 is correspondingly larger, and the signal transmission loss of the transmission signal line 16 away from the timing drive circuit 20 is correspondingly smaller, so as to balance the signal transmission losses caused by the arrangement of the clock signal line 17 and the transmission signal line 16 in the GOA circuit, so that the transmission losses of signals in transmission signal lines 16 within different distances are not greatly different, and the display effect of the display panel is more uniform accordingly.

In one embodiment, the scanning drive circuit 13 includes a common electrode layer 19 and a metal bridging hole 18. Each transmission signal line 16 is connected to the corresponding clock signal line 17 through the metal bridging hole 18. The metal bridging hole 18 includes a conductive layer 183, a first bridging hole 181 and a second bridging hole 182. The clock signal line 17 and the transmission signal line 16 are located in different manufacture procedures. The conductive layer 183 and the clock signal line 17 are connected to form the first bridging hole 181. The conductive layer 183 and the transmission signal line 16 are connected to form the second bridging hole 182. The common electrode layer 19 and the conductive layer 183 form the compensation capacitor.

Figure 7:
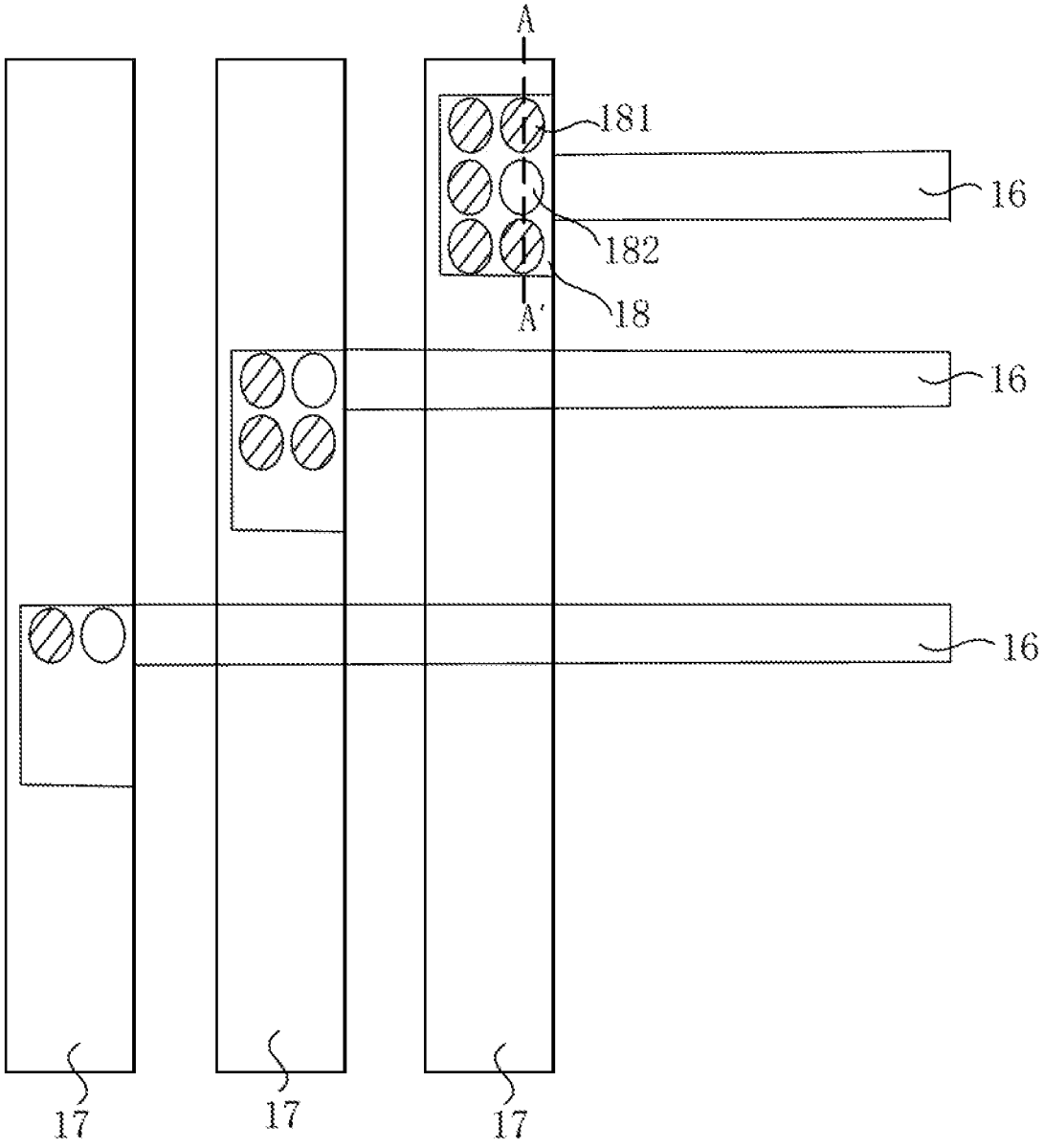
FIG. 7 is a schematic diagram of another scanning drive circuit according to one embodiment of this application.
Figure 8:
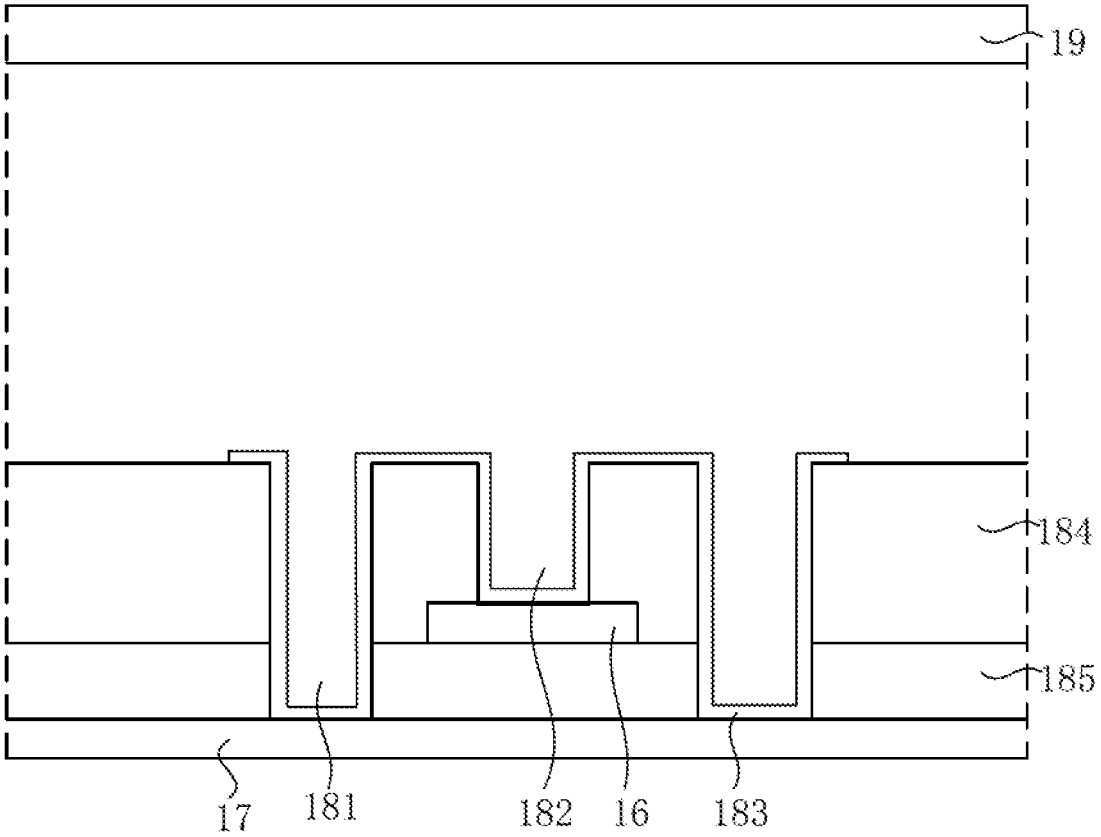
FIG. 8 is a cross schematic diagram of a metal bridging hole along a line AA according to one embodiment of this application.

In this solution, as shown in FIG. 8, it is a cross-sectional view along AA' in FIG. 7. A compensation capacitor is added to the location of the metal bridging hole 18 at a joint between the transmission signal line 16 and the clock signal line 17. By forming the compensation capacitor between the common electrode layer 19 and the conductive layer 183, the losses caused in the signal transmission process are balanced whilst the circuit architecture is not affected. The conductive layer 183 connects a clock data line and a transmission signal line, generally, array conductive glass (Array_ITO), the Array_ITO and the common electrode layer 19 (CF_com) forming the compensation capacitor. A second passivation layer 185 exists between the clock signal line 17 and the transmission signal line 16, and a first passivation layer 184 exists between the conductive layer 183 and the transmission signal line 16.

In one embodiment, the quantity of first bridging holes 181 corresponding to a transmission signal line 16, closer to the timing drive circuit 20, in the same set of transmission signal lines 16 is greater.

In this solution, in a set of transmission signal lines 16, the capacitance corresponding to a transmission signal line 16 close to the timing drive circuit 20 is greater than the capacitance corresponding to a transmission signal line 16 away from the timing drive circuit 20, thus increasing the quantity of the first bridging holes 181, equivalent to increasing the distance between two electrodes of the capacitor. The capacitance is reduced in this way, so that when the capacitance corresponding to a transmission signal line 16 away from the timing drive circuit 20 and the capacitance corresponding to a transmission signal line 16 close to the timing drive circuit 20 are equal, the transmission losses of the clock signal are consistent, and the display effect of the display panel is more uniform accordingly. In the same set, from a direction away from the timing drive circuit 20 to a direction close to a drive chip, the quantity of the first bridging holes 181 corresponding to each transmission signal line 16 increases in sequence.

As shown in FIG. 7, 3 clock signal lines 17 are grouped, there are 5 first bridging holes 181 corresponding to a transmission signal line 16 close to the timing drive circuit 20. From a direction close to the timing drive circuit 20 to a direction away from the timing drive circuit 20, the quantity of the corresponding first bridging holes 181 becomes 3, and the quantity of the first bridging holes farther away from the timing drive circuit becomes 1.

In one embodiment, the metal bridging holes 18 corresponding to a transmission signal line 16, farther away from the timing drive circuit 20, in the same set of transmission signal lines 16 include at least one first bridging hole 181.

In this solution, as the signal transmission loss of a transmission signal line 16 farther away from the timing drive circuit 20 in each set of transmission signal lines 16 is larger, the corresponding capacitance can be increased by reducing the quantity of the metal bridging holes 18, so that the loss of this transmission signal line 16 is smaller. The quantity of the corresponding metal bridging holes 18 cannot be zero, and the metal bridging hole 18 at least needs a first bridging hole 181 and a second bridging hole 182 to connect the clock signal line 17 and the transmission signal line 16.

In one embodiment, the quantity of first bridging holes 181 corresponding to a transmission signal line 16, closer to the timing drive circuit 20, in various transmission signal lines 16 connected to the same clock signal line 17 among different sets of transmission signal lines 16 is greater.

In this solution, the signal transmission loss corresponding to a transmission signal line 16 close to the timing drive circuit 20 among different sets is small, and the signal transmission loss corresponding to a transmission signal line 16 away from the timing drive circuit 20 is large. By reducing the quantity of first bridging holes 181 corresponding to a transmission signal line 16 away from the timing drive circuit 20, the capacitance corresponding to the transmission signal line 16 can be increased, so that the loss of a signal in a transmission process can be reduced, and the display effect of a display area away from the timing drive circuit 20 is uniform accordingly. In different sets, from a direction away from the timing drive circuit 20 to a direction close to a drive chip, the quantity of the first bridging holes 181 corresponding to each transmission signal line 16 increases in sequence.

In one embodiment, the area of the conductive layer 183 corresponding to a transmission signal line 16, closer to the timing drive circuit 20, in the same set of transmission signal lines 16 is greater.

In this solution, the area of the conductive layer 183 is increased, that is, the capacitance area of the conductive layer 183 and the common electrode layer 19 is increased, that is, the capacitance is increased. Correspondingly, in a set of transmission signal lines 16, if the area of the conductive layer 183 corresponding to the transmission signal line 16 farther away from the timing drive circuit 20 is larger, the capacitance is larger, the loss of a signal in the corresponding transmission signal line 16 is smaller, and as the loss is smaller, the display effect of the corresponding display panel is more uniform. In the same set, from a direction away from the timing drive circuit 20 to a direction close to a drive chip, the area of the conductive layer 183 corresponding to each transmission signal line 16 decreases in sequence.

In one embodiment, the area of the conductive layer 183 corresponding to a transmission signal line 16, closer to the timing drive circuit 20, in various transmission signal lines 16 connected to the same clock signal line 17 among different sets of transmission signal lines 16 is smaller.

In this solution, the signal transmission loss corresponding to a transmission signal line 16 close to the timing drive circuit 20 among different sets is small, and the signal transmission loss corresponding to a transmission signal line 16 away from the timing drive circuit 20 is large. By increasing the area of the conductive layer 183 corresponding to a transmission signal line 16 away from the timing drive circuit 20, the capacitance corresponding to the transmission signal line 16 can be increased, so that the loss of a signal in a transmission process can be reduced, and the display effect of a display area away from the timing drive circuit 20 is uniform accordingly. In different sets, from a direction away from the timing drive circuit 20 to a direction close to a drive chip, the area of the conductive layer 183 corresponding to each transmission signal line 16 decreases in sequence.

In one embodiment, the sum of compensation capacitances of each transmission signal line 16 and the sum of parasitic capacitances on the corresponding transmission signal line in each set of transmission signal lines 16 are equal.

In this solution, among different sets, the capacitance corresponding to each transmission signal line 16 is equal to the capacitance corresponding to each of the other transmission signal lines 16, such that the losses of signal transmission on all the transmission signal lines 16 are consistent, and the display effect of a panel is more uniform accordingly.

As another embodiment of this application, as shown in FIG. 7 to FIG. 8, a drive circuit of a display panel is disclosed, including: a timing drive circuit 20 and a scanning drive circuit 13.

The scanning drive circuit 13 includes: a plurality of sets of transmission signal lines 16; a set of clock signal lines 17, in signal connection with the timing drive circuit 20 separately to acquire a gate drive clock signal; a common electrode layer 19; and a metal bridging hole 18.

Each transmission signal line 16 in each set of transmission signal lines 16 is in signal connection with a clock signal line 17 corresponding to a set of clock signal lines 17. Each transmission signal line 16 is connected to the corresponding clock signal line 17 through the metal bridging hole 18.

The metal bridging hole 18 includes a conductive layer 183, a first bridging hole 181 and a second bridging hole 182.

The clock signal line 17 and the transmission signal line 16 are located in different manufacture procedures. The conductive layer 183 and the clock signal line 17 are connected to form the first bridging hole 181. The conductive layer 183 and the transmission signal line 16 are connected to form the second bridging hole 182.

The quantity of first bridging holes 181 corresponding to a transmission signal line 16, closer to the timing drive circuit 20, in the same set of transmission signal lines 16 is greater.

The quantity of first bridging holes 181 corresponding to a transmission signal line 16, closer to the timing drive circuit 20, in various transmission signal lines 16 connected to the same clock signal line 17 among different sets of transmission signal lines 16 is greater.

In this application, for the same set of transmission signal lines 16 connected to different clock signal lines 17, the capacitance of the transmission signal line 16 correspondingly connected to the clock signal line 17 close to a display area is different from the capacitance of the transmission signal line 16 correspondingly connected to the clock signal line 17 away from the display area, and losses caused by different capacitance sizes are also different. In each set of transmission signal lines 16 connected to different clock signal lines 17, the capacitance of the transmission signal line 16 correspondingly connected to the clock signal line 17 close to a display area is reduced to balance the situation of different losses caused by unequal capacitances due to line arrangement difference, such that the capacitance losses of each transmission signal line 16 in a set of transmission signal lines 16 keeps consistent, the signal transmission losses of different line arrangement distance areas of the display panel are the same, and the display effect of the display panel is more uniform accordingly. Specifically, among different sets, from a direction away from the timing drive circuit 20 to a direction close to a drive chip, the area of the conductive layer 183 corresponding to each transmission signal line 16 decreases in sequence. From a direction away from the timing drive circuit 20 to a direction close to a drive chip, the quantity of the first bridging holes 181 corresponding to each transmission signal line 16 increases in sequence, such that among different sets, the capacitance corresponding to each transmission signal line 16 is equal to the capacitance corresponding to each of the other transmission signal lines 16, and the losses of signal transmission on all the transmission signal lines 16 are consistent.

Figure 5:
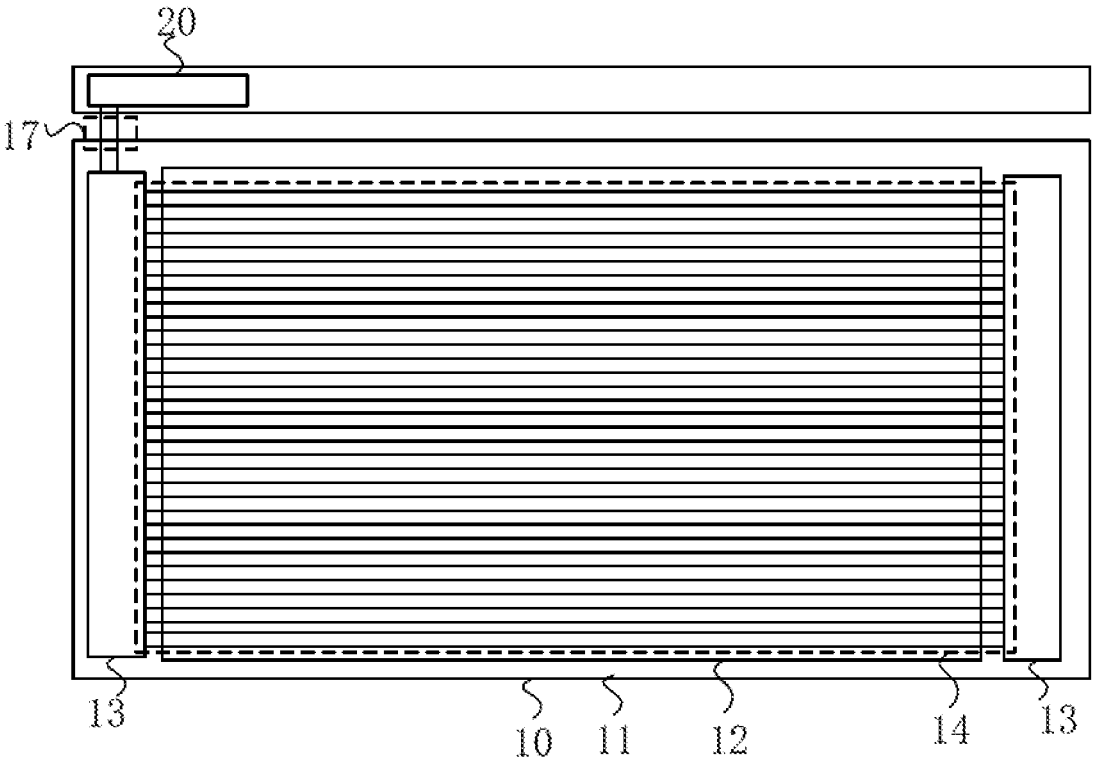
FIG. 5 is a schematic diagram of another display panel according to one embodiment of this application.

As yet another embodiment of this application, as shown in FIG. 5, a display device is disclosed. The display device includes the above drive circuit.

The technical solutions of this application can be widely applied to various display panels, such as twisted nematic (TN) panels, in-plane switching (IPS) panels, and multi-domain vertical alignment (VA) panels. Certainly, other suitable types of display panels such as organic light-emitting diode (OLED) display panels are also applicable to the above solutions.

The foregoing contents are detailed descriptions of this application in conjunction with specific embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A drive circuit of a display device, the display device comprising a display area, the drive circuit comprising:

a timing drive circuit; and a scanning drive circuit, wherein the scanning drive circuit comprises:

a plurality of sets of transmission signal lines;

a set of clock signal lines, each in signal connection with the timing drive circuit to receive a gate drive clock signal; and a compensation capacitor, connected in parallel to each transmission signal line, wherein each transmission signal line in each set of transmission signal lines is in signal connection with a corresponding clock signal line of the set of clock signal lines, wherein of the transmission signal lines in each set of transmission signal lines, the compensation capacitor coupled to the transmission signal line connected to a clock signal line closer to the display area has a smaller capacitance than the compensation capacitor coupled to the transmission signal line connected to a clock signal line relatively farther away from the display area.

2. The drive circuit according to claim 1, wherein the scanning drive circuit comprises a common electrode layer and a metal bridging hole; each transmission signal line is connected to the corresponding clock signal line through the metal bridging hole;

the metal bridging hole comprises a conductive layer, a first bridging hole and a second bridging hole;

wherein the clock signal line and the transmission signal line are located in different layers; the conductive layer and the clock signal line are connected to form the first bridging hole; the conductive layer and the transmission signal line are connected to form the second bridging hole; and the common electrode layer and the conductive layer form the compensation capacitor.

3. The drive circuit according to claim 2, wherein of the transmission signal lines in each set of transmission signal lines, a number of the first bridging holes corresponding to the transmission signal line connected to a clock signal line closer to the display area is greater than a number of the first bridging holes corresponding to the transmission signal line connected to a clock signal line relatively farther away from the display area.

4. The drive circuit according to claim 3, wherein one end of each transmission signal line overlaps the respective clock signal line thus forming an overlap area, wherein a vertical projection of the second bridging hole lies within the overlap area, and a vertical projection of each of the first bridging holes lies outside the overlap area.

5. The drive circuit according to claim 2, wherein of the transmission signal lines in each set of transmission signal lines, the metal bridging holes corresponding to the transmission signal line connected to the clock signal line the farthest away from the display area comprise at least one first bridging hole.

6. The drive circuit according to claim 2, wherein of the transmission signal lines of different sets that are connected to the same clock signal line, a number of the first bridging holes corresponding to a transmission signal line closer to the timing drive circuit is greater than a number of the first bridging holes corresponding to a transmission signal line relatively farther away from the timing drive circuit.

7. The drive circuit according to claim 2, wherein of the transmission signal lines in each set of transmission signal lines, an area of the conductive layer corresponding to the transmission signal line connected to a clock signal line closer to display area is less than an area of the conductive layer corresponding to the transmission signal line connected to a clock signal line relatively farther away from the display area.

8. The drive circuit according to claim 2, wherein of the transmission signal lines of different sets that are connected to the same clock signal line, an area of the conductive layer corresponding to the transmission signal line closer to the timing drive circuit is less an area of the conductive layer corresponding to the transmission signal line relatively farther away from the timing drive circuit.

9. The drive circuit according to claim 2, wherein the conductive layer comprises array conductive glass, which forms the compensation capacitor with the common electrode layer.

10. The drive circuit according to claim 2, wherein of the transmission signal lines in each set of transmission signal lines, the number of the first bridging holes corresponding to the transmission signal line connected to the corresponding clock signal line the farthest away from the display area is 1, and the number of the first bridging holes corresponding to each of the other transmission signal lines in the same set of transmission signal lines is incremented by 2 as the respective clock signal lines connected to the transmission signal lines draw increasingly closer to the display area; and wherein the number of the second bridging holes corresponding to each of the transmission signal lines in each set is 1.

11. The drive circuit according to claim 1, wherein a sum of a compensation capacitance and a parasitic capacitance of each transmission signal line is the same in each set of transmission signal lines.

12. A drive circuit of a display device, the display device comprising a display area, the drive circuit comprising:

a timing drive circuit; and a scanning drive circuit, wherein the scanning drive circuit comprises:

a plurality of sets of transmission signal lines;

a set of clock signal lines, each in signal connection with the timing drive circuit to receive a gate drive clock signal;

a compensation capacitor, connected in parallel to each transmission signal line, a common electrode layer; and a metal bridging hole, wherein each transmission signal line in each set of transmission signal lines is in signal connection with a corresponding clock signal line of the set of clock signal lines;

each transmission signal line is connected to the corresponding clock signal line through the metal bridging hole;

wherein of the transmission signal lines in each set of transmission signal lines, the compensation capacitor coupled to the transmission signal line connected to a clock signal line closer to the display area has a smaller capacitance than the compensation capacitor coupled to the transmission signal line connected to a clock signal line relatively farther away from the display area;

the metal bridging hole comprises a conductive layer, a first bridging hole and a second bridging hole;

the clock signal line and the transmission signal line are located in different layers; the conductive layer and the clock signal line are connected to form the first bridging hole; the conductive layer and the transmission signal line are connected to form the second bridging hole; and wherein the common electrode layer and the conductive layer form the compensation capacitor;

wherein of the transmission signal lines in each set of transmission signal lines, a number of the first bridging holes corresponding to the transmission signal line connected to a clock signal line closer to the display area is greater than a number of the first bridging holes corresponding to the transmission signal line connected to a clock signal line relatively farther away from the display area; and wherein of the transmission signal lines of different sets that are connected to the same clock signal line, a number of the first bridging holes corresponding to a transmission signal line closer to the timing drive circuit is greater than a number of the first bridging holes corresponding to a transmission signal line relatively farther away from the timing drive circuit.

13. A display device, comprising a drive circuit, the display device comprising a display area, the drive circuit comprising:

a timing drive circuit; and a scanning drive circuit, wherein the scanning drive circuit comprises:

a plurality of sets of transmission signal lines;

a set of clock signal lines, each in signal connection with the timing drive circuit to receive a gate drive clock signal; and a compensation capacitor, connected in parallel to each transmission signal line, wherein each transmission signal line in each set of transmission signal lines is in signal connection with a corresponding clock signal line of the set of clock signal lines, wherein of the transmission signal lines in each set of transmission signal lines, the compensation capacitor coupled corresponding to the transmission signal line connected to a clock signal line closer to the display area has a smaller capacitance than the compensation capacitor coupled to the transmission signal line connected to a clock signal line relatively farther away from the display area.

14. The display device according to claim 13, wherein the scanning drive circuit comprises a common electrode layer and a metal bridging hole; each transmission signal line is connected to the corresponding clock signal line through the metal bridging hole;

the metal bridging hole comprises a conductive layer, a first bridging hole and a second bridging hole;

wherein the clock signal line and the transmission signal line are located in different layers; the conductive layer and the clock signal line are connected to form the first bridging hole; the conductive layer and the transmission signal line are connected to form the second bridging hole; and the common electrode layer and the conductive layer form the compensation capacitor.

15. The display device according to claim 14, wherein of the transmission signal lines in each set of transmission signal lines, a number of the first bridging holes corresponding to the transmission signal line connected to a clock signal line closer to the display area is greater than a number of the first bridging holes corresponding to the transmission signal line connected to a clock signal line relatively farther away from the display area.

16. The display device according to claim 14, wherein of the transmission signal lines in each set of transmission signal lines, the metal bridging holes corresponding to the transmission signal line connected to the clock signal line the farthest away from the display area comprise at least one first bridging hole.

17. The display device according to claim 14, wherein of the transmission signal lines of different sets that are connected to the same clock signal line, a number of the first bridging holes corresponding to a transmission signal line closer to the timing drive circuit is greater than a number of the first bridging holes corresponding to a transmission signal line relatively farther away from the timing drive circuit.

18. The display device according to claim 14, wherein of the transmission signal lines in each set of transmission signal lines, an area of the conductive layer corresponding to the transmission signal line connected to a clock signal line closer to display area is less than an area of the conductive layer corresponding to the transmission signal line connected to a clock signal line relatively farther away from the display area.

19. The display device according to claim 14, wherein of the transmission signal lines of different sets that are connected to the same clock signal line, an area of the conductive layer corresponding to the transmission signal line closer to the timing drive circuit is less an area of the conductive layer corresponding to the transmission signal line relatively farther away from the timing drive circuit.

20. The display device according to claim 13, wherein a sum of a compensation capacitance and a parasitic capacitance of each transmission signal line is the same in each set of transmission signal lines are equal.

* * * * *